United States Patent [19]

Petersen

[11] 4,397,082

[45] Aug. 9, 1983

[54] MEMBRANE SWITCH HAVING ADHESIVE LABEL AS EDGE SEAL

[75] Inventor: Stephen K. Petersen, Rosemount, Minn.

[73] Assignee: Sheldahl, Inc., Northfield, Minn.

[21] Appl. No.: 420,273

[22] Filed: Sep. 20, 1982

Related U.S. Application Data

[62] Division of Ser. No. 159,954, Jun. 16, 1980, Pat. No. 4,375,018.

[51] Int. Cl.[3] ..... H01H 11/00

[52] U.S. Cl. ..... 29/622

[58] Field of Search ..... 29/622; 156/73.1; 200/1 R, 5 R, 5 A, 159 B, 302, 308

[56] References Cited

U.S. PATENT DOCUMENTS

| | | | |
|---|---|---|---|
| 3,886,012 | 5/1975 | Slater | 156/73.1 |
| 3,982,081 | 9/1976 | Demler, Jr. | 29/622 |
| 4,085,302 | 4/1978 | Zenk et al. | 200/5 A |
| 4,096,577 | 6/1978 | Ferber et al. | 200/5 A |

*Primary Examiner*—Carl E. Hall
*Assistant Examiner*—P. W. Echols
*Attorney, Agent, or Firm*—Orrin M. Haugen; Thomas J. Nikolai

[57] ABSTRACT

A membrane switch having a first flexible substrate segment with a pattern of conductive elements thereon at discrete coordinate locations and overlaying this substrate is a spacer layer having a plurality of apertures arranged on the same center-to-center spacing as the conductive elements on the spacer substrate. This spacer layer has the same general shape as the substrate but is of a smaller size so that when superposed on the substrate with the hole pattern aligned with the conductive elements, a border of the first substrate is exposed beyond the edges of the spacer member. Disposed atop the apertured spacer member is a further segment of flexible material also having a pattern of conductive elements at discrete coordinate locations corresponding to the coordinate locations of the conductive elements on the first substrate. When this further segment is superimposed upon the spacer layer, its conductive elements are aligned with the apertures in the spacer layer and face those on the first substrate. Again, the upper flexible layer has the same shape configuration as the bottom substrate and of the spacer member except that, again, the upper layer is of a lesser area than the other layers so that a border of the spacer layer extends outwardly beyond the edges of the uppermost layer. Completing the assembly is a sheet of flexible, non-conductive material on which is printed a pattern of desired graphic information. This graphics sheet has a pressure sensitive adhesive on its undersurface and when pressed against the exposed top layer, the adhesive serves to bond all three of the lower layers, one to the other to yield a generally impervious seal around the perimeter of the composite membrane switch assembly so as to preclude dust or moisture from entering the assembly.

3 Claims, 2 Drawing Figures

MEMBRANE SWITCH HAVING ADHESIVE LABEL AS EDGE SEAL

This is a division of application Ser. No. 159,954 filed June 16, 1980 and now U.S. Pat. No. 4,375,018.

BACKGROUND OF THE INVENTION

I. Field of the Invention

This invention relates generally to membrane or diaphragm switches, and more specifically to an improved construction of such switches whereby the reliability of the resulting product is increased and the manufacturing cost is reduced.

II. Discussion of the Prior Art

Diaphragm or membrane switches are now widely used in conjunction with a variety of electrical and electronic appliances. Typically, these switches comprise a base layer having a pattern of conductive switch contacts disposed thereon and overlaying this base layer is a spacer layer which has a plurality of apertures which are aligned with the conductive elements on the base layer when the spacer layer is superimposed on the base layer. Atop the spacer layer is a further flexible plastic layer having a pattern of conductive switch contacts on the underside thereof, this conductive pattern also being aligned with the apertures in the spacer layer. This upper layer commonly has graphics on its exposed outer surface to identify particular switch positions. The application of finger force to a marked area on the graphics layer results in the upper flexible layer being deformed through the aperture in the spacer layer so a circuit path is completed between the two switch contacts. The memory properties of the plastic from which the upper flexible layer is fabricated allow the switch contacts to separate once the finger force is removed.

It has been the existing practice in the fabrication of membrane switches to adhesively bond the spacer layer to the lower substrate and then to likewise bond the upper metallized layer to the other major surface of the spacer member. Then, the graphics may be imprinted on the exposed surface of the upper flexible layer or, alternatively, a separate label layer may be adhesively bonded to the upper flexible layer.

The various steps of bonding one layer to the other increases the overall manufacturing cost of the membrane switch. I have conceived of a way of manufacturing a membrane switch whereby the overall manufacturing cost is reduced without an attendant reduction in the reliability or useful life of the resulting switch array.

SUMMARY OF THE INVENTION

In accordance with my invention, there is provided a lower flexible substrate having a pattern of metallization thereon with conductive elements being disposed at predetermined coordinate locations. The substrate may be rectangular, circular, oval or any other shape. Next, a spacer layer is provided, the spacer layer having a pattern of apertures which correspond to the same coordinate locations as the metallization on the lower flexible substrate. The spacer layer has the same geometric shape as the lower substrate, but is of a smaller size in all dimensions so that when it is positioned atop the lower substrate layer with the apertures aligned with the pattern of metallization, a border or perimeter zone of the lower substrate will extend beyond the edges of the spacer layer. Next, a further substrate, i.e., the upper substrate, is provided and it too has a pattern of metallization on the undersurface thereof with the pattern corresponding to the same coordinates as the pattern on the lower substrate. Thus, when the upper substrate is stacked on top of the spacer layer, the conductive elements will be aligned vertically with the pattern on the lower substrate, but will be spaced apart from them by the thickness dimension of the spacer layer. Again, the upper substrate has the same geometric shape as the lower substrate and the spacer layer, but is of a smaller dimension so that when positioned atop the spacer layer the edges of the spacer layer will extend beyond those of the upper substrate around the entire perimeter of the assembly.

The upper and lower substrate segments may comprise the same sheet of flexible plastic material with their respective patterns of metallization symmetrically disposed on opposite sides of a fold-line such that when folded with the spacer layer sandwiched therebetween, their conductive segments will be aligned with the spacer apertures.

Once the various members are superimposed one above the other with the proper registration maintained, a label layer which is also formed from a flexible material and which has a pressure sensitive adhesive coated on the undersurface thereof is pressed onto the exposed upper surface of the upper substrate. The dimensions of the label layer are at least as large as those of the lower substrate and, hence, the borders of the lower substrate, the spacer layer and the upper substrate are all adhesively bonded to the label layer. Because of the staggered relationship of the various parts, no noticeable irregularity or ripple appears on the exposed surface of the label layer.

By using the technique of the present invention, it is unnecessary to use pressure sensitive adhesive to bond the spacer to the lower substrate and the upper substrate to the spacer. This appreciably reduces the manufacturing cost of the switch array. Further, because the upper label layer is adhesively bonded to the edges of all of the other layers within the diaphragm switch, a perimeter seal is established precluding moisture or dust particles from entering into the switch array and possibly compromising the integrity of the switch contacts.

OBJECTS

It is accordingly the principal object of the present invention to provide a new and improved diaphragm-type electrical switch array.

Another object of the invention is to provide an improved diaphragm-type switch array which can be produced at a lower relative cost than known prior art arrangements.

A still further object of the invention is to provide a diaphragm switch array in which the individual parts are held together by an adhesive coating applied to only one layer in the assembly.

A still further object is to provide a diaphragm-type switch array in which the spacer layer and the upper substrate are of the same shape but of a lesser area than the layers immediately below whereby when an upper label layer of the same or greater area than the lower substrate is adhesively bonded to the assembly, the several parts are each bonded to the label layer about their respective perimeters.

These and other objects and advantages of the invention will become apparent to those skilled in the art from the following detailed description of a preferred embodiment, when considered in conjunction with the accompanying drawings.

DESCRIPTION OF THE PREFERRED EMBODIMENT

Figure 1:
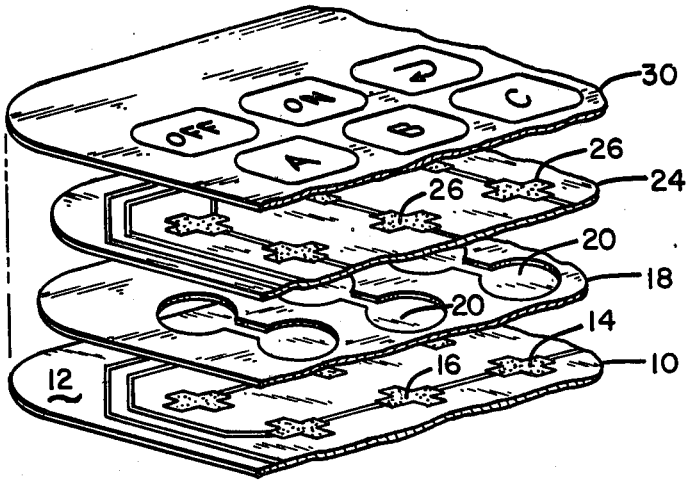
FIG. 1 is an exploded partial view of the preferred embodiment.
Figure 2:
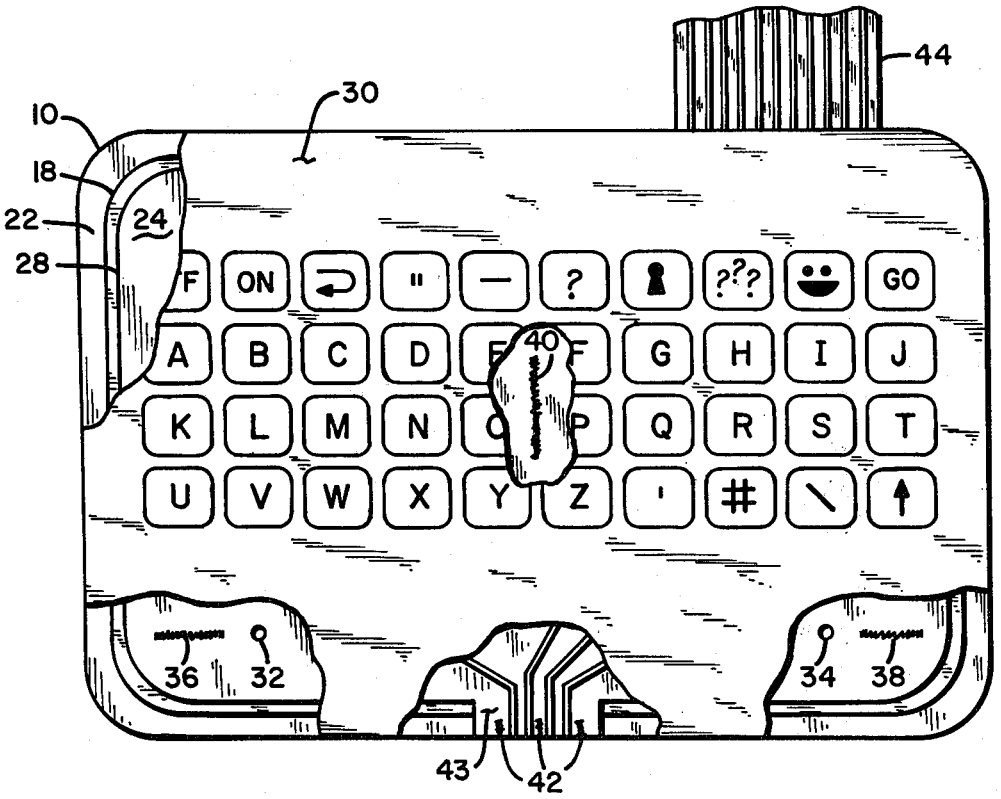
FIG. 2 is a plan view of the switch array with various layers broken away to show underlying features used in the construction.

Referring to FIG. 1, the internal construction of the diaphragm switch of the present invention is illustrated. Numeral 10 refers to the lower or base substrate and this may comprise a thin sheet of a flexible plastic material. Sheet materials of plastics sold under the trademarks Mylar, Kapton or Tradlon have been found to be entirely suitable. Formed on the upper surface 12 of the substrate 10 is a pattern of conductive elements as at 14, 16, these elements being disposed at predetermined spaced apart locations, preferably in the form of a rectangular grid. The conductive elements may be formed from a silver/graphite paste when a silk-screening process is the method employed for applying the conductive elements 14 and 16 to the substrate 10. Alternatively, the conductive pattern may be formed from copper or other conductive materials using any of the various well-known printed circuit techniques. With reference to FIG. 2, it can be seen that the lower substrate 10 may be generally rectangular in shape, but limitation to this shape is not essential as will become apparent as the description of the preferred embodiment progresses.

Disposed immediately above the lower substrate layer 10 is a spacer member 18 having a pattern of apertures, as at 20, formed through the thickness dimension thereof, the center-to-center spacing of the apertures being consistent with the center-to-center spacing of the conductive elements 14, 16, etc. on the upper surface 12 of the lower substrate 10. The spacer member has the same general shape in its plan view as the lower substrate 10, but is of a smaller area such that a border zone 22 on the lower substrate extends outwardly from the side edges of the spacer member 18 when that member is positioned on the lower substrate with the apertures 20 aligned with the metallization elements 14 and 16. The spacer layer 18 may also be fabricated from a sheet of suitable plastic material such as those trademarked Mylar, Kapton or Tradlon.

Disposed immediately above the spacer layer 18 is a further (upper) substrate layer 24. The upper substrate has a pattern of metallization on its undersurface which, too, may be formed using silk-screening, copper etching or any other suitable and well-known printed circuit process. The center-to-center spacing of the conductive elements 26 corresponds to the spacing between elements on the lower substrate 10 so that when the upper substrate layer 24 is superimposed over the spacer layer and properly registered, the conductive elements 26 will be generally aligned with the conductive elements 14 and 16, but will be maintained out of contact with one another by the thickness dimension of the spacer member 18.

The upper substrate member 24 has the same general shape in its plan view as the lower substrate and the spacer member. However, the area of the upper substrate 24 is less than that of the spacer member such that when properly registered, a border zone 28 (FIG. 2) extends beyond the edges of the upper substrate 24.

Completing the assembly is an upper label layer 30 which may typically have alphanumerics or other graphics printed thereon at spaced apart locations corresponding to the locations of the metallization elements 26, the apertures 20 and the elements 14, 16 on the several layers. The label layer 30 is also preferably formed from a suitable flexible plastic material having a memory property and on the undersurface thereof is a coating of a suitable pressure-sensitive adhesive. The layer 30 is generally of the same size as the lower substrate 10 such that when it is pressed firmly into contact with the members 24, 18 and 10, the exposed borders 22, 28 and the surface 24 will all adhere to the label layer 30, thereby holding all of the parts together and forming a seal about the entire perimeter.

With reference to FIG. 2, during manufacture, it has been found convenient to form registration holes 32 and 34 through the layers 10, 18 and 24. Then, by stacking these parts onto a manufacturing jig having spaced-apart pins extending upward from it, the parts are held in proper registration. Once so registered, it has also been found helpful to ultrasonically bond or otherwise tack or join the layers 24, 18 and 10, one to the other, as at 36, 38 and 40 to hold the various parts in their proper registration during handling prior to the application of the adhesively coated label layer 30 as the final step in the manufacturing process.

Furthermore, it has been found expedient from a cost standpoint to use a common sheet of flexible plastic material for both the lower substrate 10 and the upper substrate 24. To do so, the pattern of metallization is formed symmetrically on opposite sides of a fold-line such that when the common substrate is folded along that line with the spacer layer 18 inserted between the folded "halves" the metallized elements on the lower half will be vertically aligned with those on the upper half. The common sheet is also cut so that the portion which will become the upper substrate section will be of lesser size than either the lower portion or the spacer to be used, the two segments being joined only by narrow strips 43 which permit conductors to extend between the two "halves". To ensure that the fold zone does not spread apart and overcome the adhesive force of the label layer to thereby destroy the seal, it has been found helpful to also ultrasonically bond the substrates together in the zone of the strips 43 proximate their point of folding as at 42. Numeral 44 refers to the portion of the substrate having conductors thereon which is brought out to be connected to the external circuitry with which the switch array is to be used.

Because the members 18 and 24 are gradually stepped inwardly from the outermost edge perimeter of the assembly, no noticeable or unsightly step is observable on the exposed outer surface of the label layer 30.

Where the diaphragm switch array of the present invention is to be used on an appliance having a generally flat surface, it has been found expedient to extend the borders of the label layer outward beyond the edges of the lower substrate 10 and, in this fashion, the switch assembly may be adhesively bonded to the flat surface of the appliance.

There has been shown and described a preferred embodiment of the invention and the best mode contemplated by me for carrying out the invention. Those skilled in the art, upon reading the present specification may conceive of variations which do not depart in spirit from the true scope of the invention. Accordingly, it is intended that the scope of the invention be determined from the accompanying claims.

What is claimed is:

1. A method of making a membrane switch array comprising the steps of:

(a) providing a substrate of flexible insulative material adapted to be folded about a fold line;

(b) forming first and second sets of conductive elements at predetermined coordinate locations on opposite sides of said fold line;

(c) forming a spacer member having a pattern of apertures corresponding to the spacing of said predetermined coordinate locations from a sheet of flexible insulative material, the outer dimensions of said spacer member being less than the corresponding dimensions of a portion of said substrate on one side of said fold line;

(d) juxtaposing said spacer member on said pattern of said substrate on said one side of said substrate with said apertures surrounding said first set of conductive elements;

(e) folding said substrate along said fold line so that the second set of conductive elements on said substrate are surrounded by said apertures; and (f) adhesively bonding a label layer to the folded substrate such that said label layer is adhesively bonded directly to predetermined perimeter areas of said substrate and said one side of said spacer member and to the other side of said spacer member.

2. The method as in claim 1 and further including the step of:

(a) cutting said substrate such that the portion of said substrate on the other side of said fold-line is of a shape corresponding to the shape of said spacer member but of a lesser area.

3. The method as in claim 1 and further including the step of:

(a) ultrasonically bonding said folded substrate and spacer member at plural discrete points to hold those parts in registration prior to the attachment of said label layer to said folded substrate.

* * * * *